United States Patent [19]

Wallis

[11] Patent Number: 4,528,838

[45] Date of Patent: Jul. 16, 1985

[54] NITROGEN DIE CYLINDER

[76] Inventor: Bernard J. Wallis, 25315 Kean Ave., Dearborn, Mich. 48124

[21] Appl. No.: 614,065

[22] Filed: May 25, 1984

[51] Int. Cl.[3] ..... B21J 9/18

[52] U.S. Cl. ..... 72/453.13; 267/124

[58] Field of Search ..... 72/453.13, 453.01, 465; 267/124, 125, 137; 92/117 R

[56] References Cited

U.S. PATENT DOCUMENTS 3,162,159 12/1964 Krauss et al. ..... 72/453.13

*Primary Examiner*—Francis S. Husar

*Assistant Examiner*—Linda McLaughlin

*Attorney, Agent, or Firm*—Barnes, Kisselle, Raisch, Choate, Whittemore & Hulbert

[57] ABSTRACT

A nitrogen die cylinder is disclosed having an upright post threaded at its lower end into the wall of a manifold containing nitrogen at high pressure. The post has a central vertical passageway extending therethrough and communicating with the manifold. A cylindrical sleeve having a top wall is telescoped over the post. A seal at the upper end of the post engages the bore of the sleeve to form a chamber between the seal and the top wall of the sleeve which, when pressurized, urges the sleeve upwardly on the post. The top wall of the post has a noncircular socket therein which is accessible through an opening in the top wall of the sleeve which is normally closed and sealed by means of a threaded plug.

6 Claims, 1 Drawing Figure

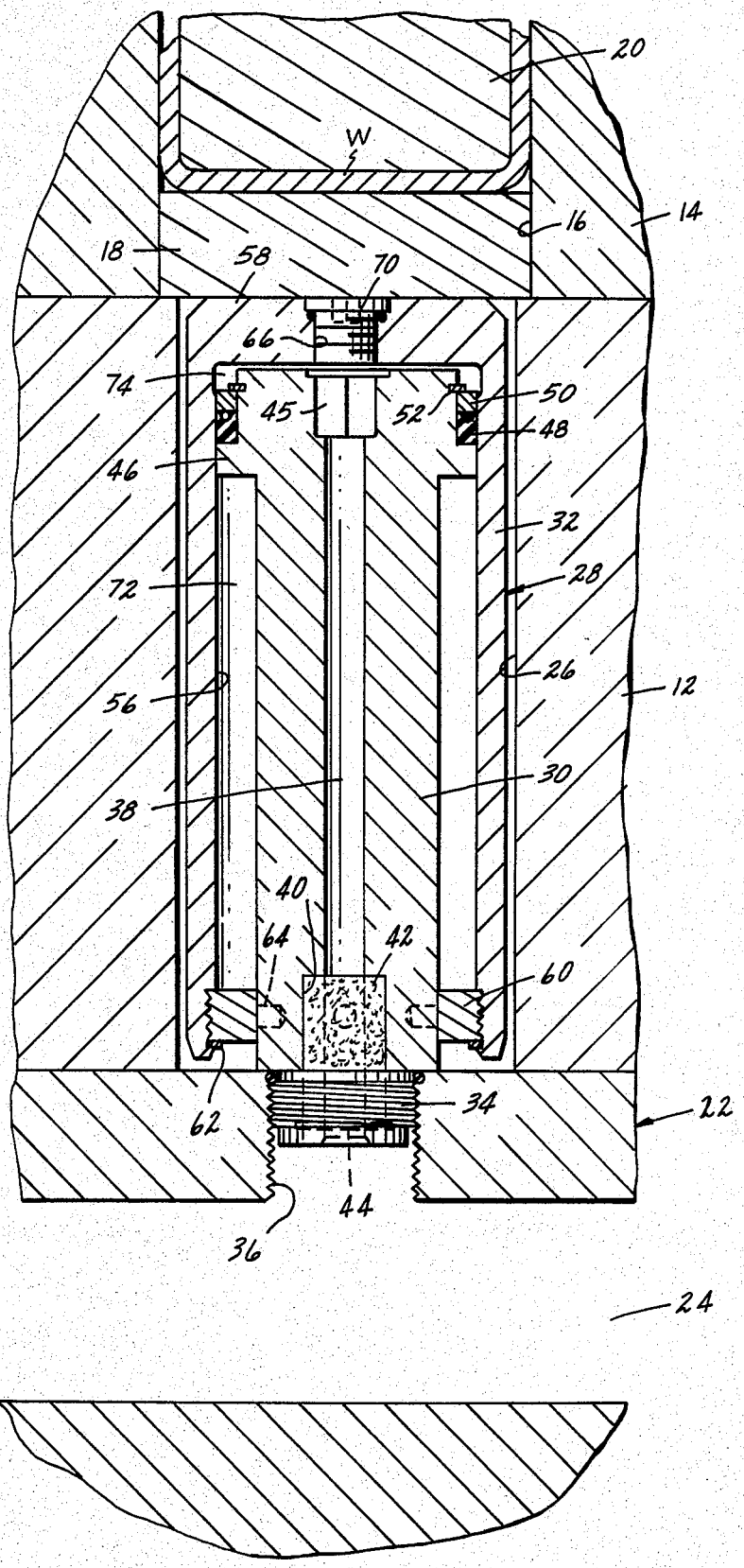
20
W
16
14
18
58
70
66
74
45
52
50
48
46
32
72
28
26
12
56
30
38
40
64
42
60
62
34
22
44
36
24

NITROGEN DIE CYLINDER

This invention relates to a nitrogen die cylinder.

In stamping press operations it is common practice to employ die springs in the form of a fluid cylinder charged with nitrogen under relatively high pressure. The nitrogen cylinder usually comprises an open-ended cylinder in which is slideably arranged a piston having a rod which projects axially outwardly through the open end of the cylinder. The piston rod normally has a diameter less than the piston and cylinder bore so that an annular space is formed between the piston rod and the surrounding cylinder bore. The open end of the cylinder is frequently provided with a wiper and/or an annular seal to seal the nitrogen within the cylinder and to seal the annular chamber from the surrounding atmosphere. In many instances the environment around a die is contaminated with oil, dirt, grinding dust, etc. which, if permitted to leak into the cylinder, can cause serious problems in a relatively short period of time. Seals and wipers are not always effective to prevent the ingress of such contaminants into the cylinder.

Another problem sometimes encountered with die cylinders relates to the lack of space. In some applications, in order to apply the large force required to the movable die element against which the cylinder is acting, the cross sectional area of the piston must be maximized and/or the number of cylinders employed must be numerous. This requirement frequently results in design problems with respect to size limitations inherent in some dies and the lack of adequate space between cylinders for access to them when they require servicing or replacement.

The present invention has for its primary object the provision of a nitrogen die cylinder which overcomes the problems referred to above.

Another object of this invention is to provide a compact die cylinder which occupies a minimum of space in relation to the force it is adapted to exert.

A further object of the invention is to provide a die cylinder arrangement wherein the seal between the piston and the cylinder is effectively shielded from the contaminants in the surrounding environment.

In the drawing a die is illustrated at 10 which includes a riser 12 on which a die member 14 is supported. Die member 14 is formed with a cavity 16 in which a stripper pad 18 is arranged for sliding movement. A punch 20 is axially aligned with cavity 16 and is reciprocated vertically by the press ram (not shown). Punch 20 has a cross section slightly smaller than cavity 16 so that when the punch descends into the cavity the workpiece W is formed to the desired configuration. Riser 12 is supported on the top wall of a manifold 22 having a passageway 24 therein which is charged with nitrogen at a relatively high pressure, for example, 1000 p.s.i.

Riser 12 is formed with a vertically extending cylindrical pocket 26 in Which a piston-cylinder unit 28 is arranged. The unit 28 includes a center post 30 over the upper end of Which is telescoped a sleeve 32. Post 30 has a threaded boss 34 at its lower end which is in sealed engagement with a threaded port 36 in manifold 22. The post is formed with an axial passageway 38 which is enlarged at its lower end as at 40. Within the enlarged portion 40 of the passageway there is arranged an oil wick 42. The boss 34 at the lower end of post 30 has a central vertical passageway 44 therein which registers with the enlarged portion 40 of passageway 38. The upper end of passageway 38 is formed with a non-circular socket 45.

Adjacent its upper free end post 30 is formed with an annular, radially outwardly projecting shoulder 46. On the top side of shoulder 46 there is arranged an annular seal 48 and a bronze bearing bushing 50. Seal 48 and bushing 50 are retained in assembled relation on shoulder 46 by means of a snap ring 52.

Sleeve 32 is formed with a bore 56 which is closed at its upper end by a top wall 58. Bore 56 has a diameter larger than the outer diameter of post 30. The outer diameter of sleeve 32 is slightly smaller than the diameter of pocket 26 and also smaller than the diameter of stripper pad 18. Adjacent its lower end sleeve 32 has a bronze bearing bushing 60 threaded into the bore thereof and retained in place by a snap ring 62. The inner periphery of bushing 60 slideably engages the outer periphery of post 30. Adjacent its lower end the outer periphery of post 38 is formed with a plurality of circumferentially spaced recesses 64 which are adapted to be engaged by a spanner wrench for rotating the post. The top wall 58 of sleeve 32 is formed with a threaded opening 66 which is closed and sealed by a threaded plug 70. Plug 70 is dimensioned such that, when it is threaded into opening 66, it does not project above the upper face of top wall 58.

The annular space 72 below shoulder 46 and between the outer periphery of post 30 and bore 56 communicates with pocket 26 through bushing 60. On the other hand, the working chamber 74 is formed by the portion of bore 56 above shoulder 46 sealed from the surrounding atmosphere by seal 48 and is at all times in communication with the manifold passageway 24 in the manifold by reason of the passageway 38 in post 30.

When the piston-cylinder unit 28 is assembled in a die as shown in the drawing and the manifold 22 is charged with nitrogen at a pressure of, for example, 1000 p.s.i., this pressure acts upwardly against the underside of wall 58 throughout the cross sectional area of bore 56 and thus urges sleeve 32 upwardly. Thus, the effective cross sectional area of sleeve 32 for applying an upward force on stripper pad 18 is equal to the cross sectional area of sleeve 32 less only the cross sectional area of the thin depending skirt wall of the sleeve. This enables the unit to exert a maximum upward force on pad 18 in relation to its cross sectional area. It Will be noted in addition that, since seal 48 is located at the upper end of the stationary post 30, it is virtually impossible for any contaminants in the die environment, such as dirt, grinding dust, oil, etc., to reach seal 48 and leak into chamber 74 and the manifold passageway 24. At bottom dead center of the press ram, the position shown in the drawing, the lower end of sleeve 32 is spaced above the top face of manifold 22 and the bottom face of end wall 58 is spaced above the upper end of post 30.

In the assembly illustrated the piston-cylinder unit 28 is located within the closely fitting pocket 26. In some applications, instead of locating the unit within a pocket, several piston-cylinder units may be arranged on a manifold in closely spaced relation. In either arrangement there is insufficient space around the unit to gain access to the lower end of post 30 for the purpose of applying a spanner wrench to the recesses 64. In such arrangements the unit can be serviced by simply removing plug 70 and inserting a suitable tool through the opening 66 in top wall 58 of sleeve 32 and engaging the end of the tool with socket 45 to enable removal of post 30 from the manifold. It follows that where the piston-cylinder units 28 are arranged in closely confined spaces, they may be installed on the manifold in the same manner; namely, by threading the post 30 into the threaded port 36 by removing plug 70 and rotating the post by means of a tool engaging the non-circular socket 45 at the upper end of the post.

I claim:

1. In combination a die having a vertically movable member and a plate spaced vertically therefrom, a piston-cylinder assembly extending between said plate and said movable die member, said assembly comprising a vertically extending post having a threaded boss at one end thereof, said plate having a threaded port in which said boss is threaded to mount the post on said plate, a cylindrical sleeve having an axial bore closed by an end wall at one end and open at its opposite end, the open end of the sleeve being telescoped over the free end of the post so that the sleeve is vertically slideable on the post, said post having an axially extending cavity therein which is open at the free end of the post, said boss having an axial passageway therethrough communicating with said cavity, means connecting said passageway with a source of nitrogen at high pressure, said post having a bushing mounted adjacent its free end and slideably engaging said bore, said post also having mounted adjacent the free end thereof an annular seal in sealing engagement with said bore and the outer periphery of said post, said cavity communicating at the free end of the post with the portion of said bore extending between the closed end of the sleeve and said seal and being out of communication with the portion of said bore extending beyond said seal toWard the open end of the sleeve so that the closed end of the sleeve is biased axially into force engagement with said movable die member when said cavity is pressurized from said source, said sleeve having a bushing mounted thereon adjacent its open end which slideably engages the outer periphery of the post, means adjacent the free end of the post forming an annular shoulder adapted to be axially abutted by said last-mentioned bushing to limit the extent of movement of the sleeve in a direction away from said plate, the closed end of the sleeve having a threaded hole therethrough at the vertical central portion thereof, a plug threaded into said hole and sealed therein, the free end of said post having means thereon axially aligned with said threaded hole and adapted to be engaged by a turning tool inserted through said threaded hole when the plug is removed to rotate the post and thereby enable the boss to be threaded into and out of engagement with said threaded port.

2. The combination called for in claim 1 wherein said plate comprises a wall of a manifold containing nitrogen at high pressure and said threaded port extends through said manifold to establish communication between said source of high pressure nitrogen and said cavity.

3. The combination called for in claim 1 wherein the exterior of the post is provided with means adjacent said boss adapted to be engaged by a turning tool to rotate the post and thereby enable the boss to be threaded into and out of said port when the sleeve is extended and the outer periphery of the post adjacent the boss is accessible from a lateral direction.

4. The combination called for in claim 1 wherein the post and sleeve are dimensioned such that when the vertically movable die member is in its lowermost position, the open end of the sleeve is spaced from said plate and the end wall of the sleeve is spaced from the free end of the post.

5. The combination called for in claim 1 including means on said die spaced radially closely adjacent the post and obstructing lateral access to the periphery of the post adjacent the boss.

6. The combination called for in claim 1 wherein said means at the free end of the post comprises a noncircular socket.

* * * * *